United States Patent [19]

Leupold et al.

[11] Patent Number: 5,028,902

[45] Date of Patent: Jul. 2, 1991

[54] PERMANENT MAGNET FIELD SOURCES OF RADIAL ORIENTATION

[75] Inventors: Herbert A. Leupold, Eatontown; Ernest Potenziani, II, Ocean, both of N.J.

[73] Assignee: The United States of America as represented by the Secretary of the Army, Washington, D.C.

[21] Appl. No.: 532,539

[22] Filed: Jun. 4, 1990

[51] Int. Cl.[5] ..... H01F 7/02

[52] U.S. Cl. ..... 335/306; 315/5.35

[58] Field of Search ..... 335/301, 304, 306; 315/5.35

[56] References Cited

U.S. PATENT DOCUMENTS 3,205,415 9/1965 Seki et al. ..... 335/301 X 3,768,054 10/1973 Neugebauer ..... 335/304

*Primary Examiner*—George Harris

*Attorney, Agent, or Firm*—Michael Zelenka; Ann Knab

[57] ABSTRACT

A permanent magnet structure comprises a flux source having a central cavity wherein a highly uniform magnetic field is produced of radial orientation. The flux source comprises a pair of radially magnetized discs of MR material. The discs are coaxially aligned parallel to and separated from each other a given distance. A ring fabricated of passive ferromagnetic material circumscribes the peripheries of the discs, and cladding magnets cover the planar exterior surface of each disc.

10 Claims, 1 Drawing Sheet

PERMANENT MAGNET FIELD SOURCES OF RADIAL ORIENTATION

The invention described herein may be manufactured, used, and licensed by or for the Government for governmental purposes without payment to us of any royalties thereon.

TECHNICAL FIELD

The present invention relates generally to permanent magnet structures, particularly to the arrangement of permanent magnet structures to produce high magnetic fields of uniform flux density, and more particularly to the use of permanent magnets in the construction of an apparatus for processing radially oriented permanent magnet materials.

BACKGROUND OF THE INVENTION

Many devices that employ magnetic fields have heretofore been encumbered by massive solenoids with their equally bulky power supplies. Thus, there has been increasing interest in the application of permanent magnet structures for such uses as electron-beam focusing and biasing fields. The current demand for compact, strong, static magnetic field sources that require no electric power supplies has created needs for permanent magnet structures of unusual form.

Various prior art structures have contributed to the development of technology in this area. For example, U.S. Pat. No. 4,701,737 to Leupold, entitled "Leakage-Free, Linearly Varying Axial Permanent Magnet Field Source" and U.S. Pat. No. 4,692,732 to Leupold et. al., entitled "Remanence Varying In A Leakage Free Permanent Magnet Field Source" (both incorporated by reference herein) both disclose magnetic circuits utilizing magnetic cladding means to reduce exterior flux leakage and increase the controlled magnetic field intensity. The advantageous features of this and similar devices are, significantly, the reduction of field loss and very effective control without any increase, in fact most times a decrease, in the size or weight of the magnetic circuit elements.

The present invention relates to applicants' co-pending application, Ser. No. 436,407 filed Nov. 14, 1989, entitled "Permanent Magnet Field Sources Of Conical Orientation" which is hereby incorporated by reference. A structure fabricated of magnetically rigid (MR) material combines a radial magnetic field source with an axial magnetic field source to produce a conical magnetic field source. MR materials are well known to those skilled in the magnetic arts. Some ferrites and rare-earth alloys have been utilized or are being contemplated for use as MR materials, such as barium ferrite, samarium cobalt and neodymium-iron-boron alloys. The most pronounced characteristic of MR materials is their very high coercivity (field magnitude required to demagnetize) relative to that of traditional magnetic materials. This characteristic affords the fabrication of structures that exhibit various magnetic circuit effects such as field transparency and flux confinement that are not attainable with traditional materials. As to field transparency, external magnetic fields up to some magnitude greater than the remanence (magnetized level) of MR material will pass therethorough without affecting the magnetic orientation thereof. A resultant field occurs equal to the vector sum of the external field and the field sustained by the MR material.

With respect to the flux confinement, the magnitude and direction of the magnetization is constant throughout any individual piece or segment of MR material. Therefore, a field source can be constructed of magnetic segments fabricated of MR material, to configure a magnetic circuit as desired and even to completely confine a whole magnetic circuit by enclosing a magnetic field in a cavity.

SUMMARY OF THE INVENTION

A primary object of the invention is to provide a flux source of MR material with which a uniformly high magnetic field within the central cavity is obtained.

It is a related object of the invention to provide a flux source with a magnetic field of radial orientation.

A further object of the invention is to provide the above-stated source of flux with minimum flux leakage.

These and other objects are accomplished in accordance with the present invention wherein a permanent magnet structure comprises a flux source having a central cavity wherein a highly uniform field of radial orientation is produced. The flux source comprises a pair a radially magnetized discs of MR material, coaxially aligned parallel to and separated from each other a given distance. A ring of soft ferromagnetic material circumscribes the peripheries of the discs and cladding magnets cover the planar exterior surfaces of the discs.

BRIEF DESCRIPTION OF THE DRAWINGS

The invention will be more fully appreciated from the following detailed description when the same is considered in connection with the accompanying drawings in which.

DETAILED DESCRIPTION OF THE DRAWINGS

Figure 1:
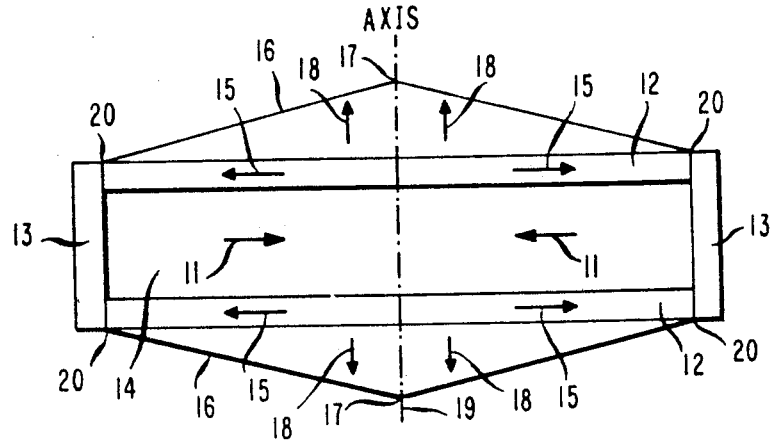
FIGS. 1,2,3 and 4 are cross-sectional schematic diagrams of flux source structures in accordance with the invention, illustrating the magnetizations in the segments of the structures.

FIG. 1 shows a clad radial field flux source 10. The radially directed magnetic field (denoted by arrows 11) is generated by magnetic discs 12, coaxially aligned parallel to and separated from each other a given distance. The separation distance between the discs may be any desired distance, although typically, the distance is approximately equal to one quarter the length of the discs 12. A ring 13, fabricated of passive ferromagnetic material such as iron, circumscribes and contacts the peripheries 20 of discs 12, thereby forming an internal cavity 14. Arrows 15 illustrate the magnetic orientation of the discs 12, which create the radial magnetic field 11, directed inward. The ferromagnetic ring 13 assures approximately uniform flux in the radial direction of the cavity 14. Cladding magnets 16 are disposed exterior to the planar face of each disc 12 and extend out to the ring 13, the exterior surface of each magnet 16 decreasing linearly in thickness with radial distance from the central axis 19 to outer periphery 20. The magnetic orientation 18 of each magnet 16 is in a direction perpendicular to and away from the plane of the magnetic discs 12.

The addition of the cladding magnets 16 to the magnetic discs 12 prevents leakage of flux to the outside of cavity 14. To eliminate leakage, it is necessary to have all points on the outer surface of the cladding magnets 16 at the same magnetic potential. In this structure, the center, at axis 19, of the magnetic discs 12 is chosen to be at zero potential. Thus, the maximum potential occurs at the outer surface or periphery 20. Along the exterior surface of discs 12, from zero potential at the center to maximum potential at the outer periphery, the potential at any point P along the radius between zero and maximum potential is equal to the magnetic field multiplied by the distance from zero potential. To counter the effect of potential at point P, an opposing potential is provided by the cladding magnet. Therefore, the thickness of the cladding magnet at point P is proportional to the distance from zero potential to point P in order to counteract the magnetomotive force of the magnetic discs 12 at point P. Since the direction of the magnetic orientation on the cladding magnets 16 is out and away from the magnetic discs 12 the thickness of the cladding magnets decreases from the center (zero potential) to the outer periphery 20. As a result, every point on the exterior of cladding magnets 16 is at zero potential and magnetic flux leakage is substantially reduced.

Figure 2:
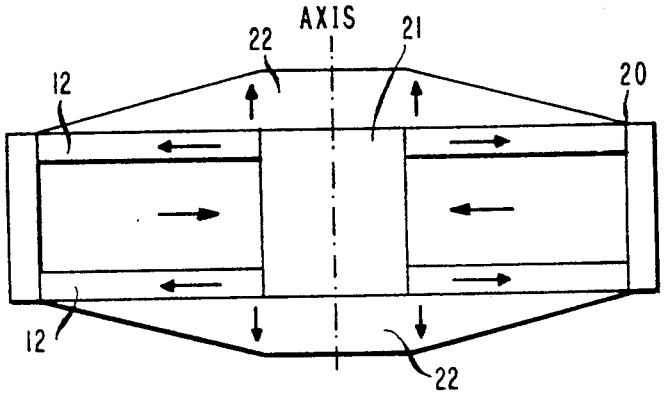

FIG. 2 is a variation of flux source 10 of FIG. 1 wherein the magnetic discs 12 are drilled with bore holes at their centers and a core 21, fabricated of passive ferromagnetic material such as iron, is inserted through the bore holes. The cladding magnets 22 are constant in thickness over iron core 21, thereafter the exterior surface of each magnet 21 decreases linearly in thickness with radial distance to outer periphery 20. Due to the addition of iron core 21, the flux lines will not bow or bend, but will continue in a straight path, thereby improving field uniformity.

Figure 3:
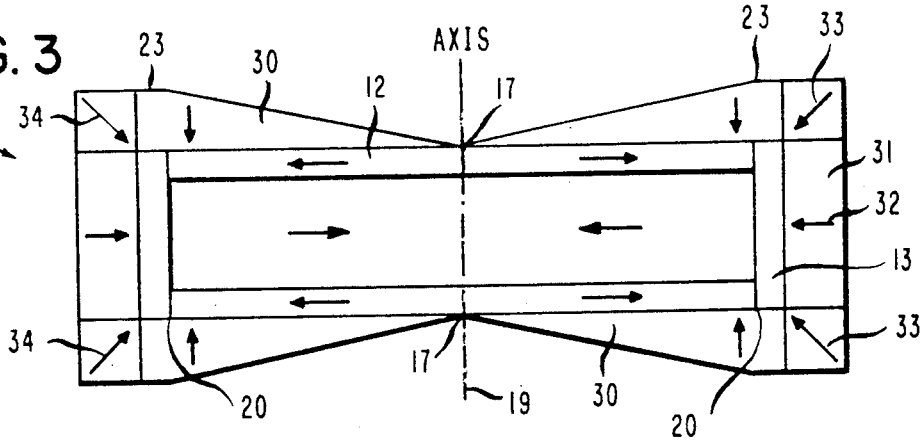

FIG. 3 illustrates another embodiment of the invention. Cladding magnets 30 are disposed exterior to the planar face of each disc 12 and extend out over the iron ring. The exterior surface of each magnet 30 increases linearly in thickness with radial distance from the central axis 19 to the iron ring 13, whereat the thickness becomes constant (represented by flat surface 23) to the outer surface thereof. The center of each magnetic disc 12 at central axis 19 is chosen to be at zero potential. Therefore, the outer periphery 20 will be at maximum potential. Since the magnetic orientation of cladding magnets 30 is directed inward, the thickness of magnets 30 will increase from the point of zero potential to that of maximum potential. As a result, every point on the cladding magnets 30 is at zero potential and magnetic flux leakage is substantially reduced. Iron ring 13 will have a higher magnetic potential than the exterior surface of cladding magnet 30. This magnetic potential difference will result in magnetic flux leakage. To avoid this, bucking end magnet 31 is used to buck or off-set the magnetic potential of iron ring 13 so that the the magnetic potential of exterior surface of bucking magnet 31 is equal to the magnetic potential along exterior surface of magnet 30. Bucking end magnet 31, circumscribing iron ring 13, is annularly shaped and is magnetized radially in the direction shown by arrows 32 thereon. To further prevent leakage at the corner between bucking end magnet 31 and cladding magnets 30, ring-shaped bucking corner magnets 33 are disposed between magnets 30 and magnet 31. Bucking corner magnets 33 are magnetized in an inward angular direction denoted by arrows 34.

Figure 4:
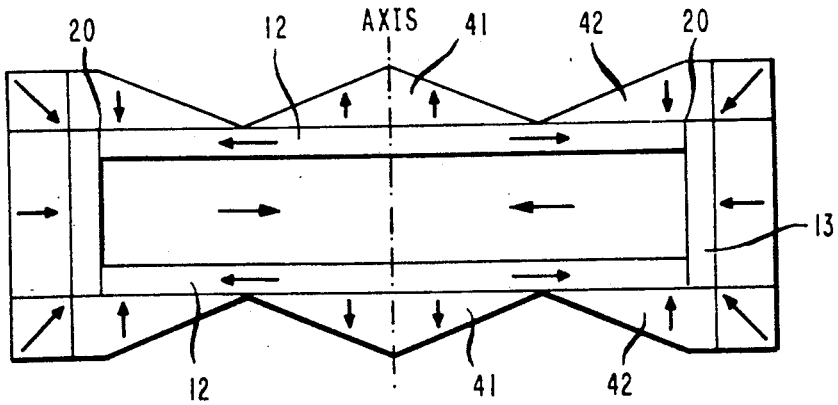

FIG. 4 shows yet another embodiment cf flux source 10. Cladding magnets 41 are disposed over the central portion of the planar face of each disc 12, the exterior surface of each magnet 41 decreasing linearly in thickness in radial distance from central axis 19 to outer surface thereof. Cladding magnets 42, the exterior surfaces thereof increasing linearly in thickness in radial distance toward outer periphery 20, are disposed adjacent to cladding magnets 41, and extend over the remaining surface of each disc 12, continuing over iron ring 13. The cladding in this flux source structure is a combination of cladding used in FIGS. 1 and 3. It works in the same way as described above, eliminating any magnetic potential difference, thereby preventing flux leakage.

Each of the magnetic structures of FIGS. 1 through 4 just described results in a radially uniform and axially uniform magnetic field directed in the radial direction in cavity 14. The structures just described are only different with respect to the cladding that is used. Furthermore, the magnetization on the magnetic segments of all the embodiments set forth in this disclosure, may be reversed, resulting in structures producing radial fields in a direction out and away from the central axis.

FIG. 1 will be referred to in discussing the operation of the device. One possible use of this device is for the process of magnetizing magnetic materials in the radial direction. During operation, the top disc 12 with the cladding 16 thereon, will be lifted from the structure. A magnet will then be inserted into cavity 14, and the top disc plus cladding will be placed over the magnet. The magnet will remain therein until it becomes radially magnetized. As a result, a magnet with uniform radial magnetic orientation is realized.

It should be understood that the embodiments depicted can be combined in different configurations, and that numerous modifications or alterations may be made therein without departing from the spirit and scope of the invention as set forth in the appended claims.

What is claimed is:

1. A permanent magnet structure comprising:

a flux source having a central cavity, said flux source producing a radial field in said central cavity, wherein said flux source comprises a pair of magnetic discs of constant thickness fabricated of magnetically rigid material, said pair of magnetic discs being coaxially aligned parallel to and separated from each other at a given distance and said magnetic discs having a radial magnetic orientation in a direction out toward a periphery of said discs, a ring fabricated of passive ferromagnetic material circumscribing and contacting said discs, and cladding magnets disposed exteriorly to the planar face of each disc, said cladding magnets having an axial magnetic orientation in a direction perpendicular to said magnetic orientation of said discs.

2. A permanent magnet structure as defined in claim 1 wherein the exterior surface of each cladding magnet decreases linearly in thickness in radial distance from the center to the outer periphery of said disc.

3. A permanent magnet structure as defined in claim 2 wherein each cladding magnet has a magnetic orientation in the direction out and away from said discs.

4. A permanent magnet structure as defined in claim 1 wherein the exterior of each cladding magnet increases linearly in thickness in radial distance from the center to the outer periphery thereof.

5. A permanent magnet structure as defined in claim 4 further comprising bucking end magnets circumscribing said ring, and bucking corner magnets disposed between said cladding magnets and said bucking end magnets.

6. A permanent magnet structure as defined in claim 5 wherein said bucking end magnets have a radial magnetic orientation in a direction inward and said bucking corner magnets have an angular magnetic orientation in a direction inward.

7. A permanent magnet structure as defined in 1 wherein the cladding magnets sections, the first section disposed over the central portion of each disc, the exterior surface of each first section decreasing linearly in thickness in radial distance from the center toward the outer periphery of said disc, the second section disposed adjacent to said first section, the exterior surface of each second section increasing linearly in thickness in radial distance to the outer periphery of said disc.

8. A permanent magnet structure as defined in claim 7 wherein said first section has an axial magnetic orientation in a direction outward and said second section has a axial magnetic orientation in a direction inward.

9. A permanent magnet structure as defined in claim 7 further comprising bucking end magnets circumscribing said ring, and bucking corner magnets disposed between said cladding magnets and said bucking end magnets 10. A permanent magnet structure as defined in claim 8 wherein said bucking end magnets have a radial magnetic orientation in a direction inward and said bucking corner magnets have an angular magnetic orientation in a direction inward

* * * * *